US007099600B2

(12) United States Patent
Hattori

(10) Patent No.: US 7,099,600 B2
(45) Date of Patent: Aug. 29, 2006

(54) IMAGE FORMING DEVICE THAT PERFORMS DENSITY DETECTION

(75) Inventor: Tomoaki Hattori, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 21 days.

(21) Appl. No.: 10/813,303

(22) Filed: Mar. 31, 2004

(65) Prior Publication Data

US 2005/0002680 A1 Jan. 6, 2005

(30) Foreign Application Priority Data

Mar. 31, 2003 (JP) ..... 2003-093929

(51) Int. Cl.
*G03G 15/00* (2006.01)

(52) U.S. Cl. ..... 399/49; 399/39; 399/60; 399/72

(58) Field of Classification Search ..... 399/39, 399/49, 60, 72, 52, 54
See application file for complete search history.

(56) References Cited

U.S. PATENT DOCUMENTS 3,841,251 A * 10/1974 Larson ..... 114/39.28
3,841,751 A * 10/1974 Draugelis et al. ..... 430/47
4,251,152 A * 2/1981 Miyakawa et al. ..... 399/3
4,457,615 A * 7/1984 Seanor ..... 399/148
4,833,506 A * 5/1989 Kuru et al. ..... 399/22
5,083,160 A * 1/1992 Suzuki et al. ..... 399/39
5,722,009 A * 2/1998 Haneda et al. ..... 399/60
5,950,042 A * 9/1999 Goto et al. ..... 399/53
5,963,756 A * 10/1999 Sakai et al. ..... 399/39
5,978,615 A * 11/1999 Tanaka et al. ..... 399/49
6,144,811 A * 11/2000 Ohori et al. ..... 399/9
6,389,240 B1 * 5/2002 Toyohara et al. ..... 399/38
6,429,886 B1 8/2002 Ohki
6,452,147 B1 9/2002 Inada
6,501,917 B1 * 12/2002 Karasawa ..... 399/46
6,505,010 B1 * 1/2003 Izumizaki et al. ..... 399/39
6,812,996 B1 * 11/2004 Horiuchi et al. ..... 355/35
2004/0165899 A1 * 8/2004 Chigira ..... 399/49
2004/0229143 A1 * 11/2004 Umemura et al. ..... 430/108.4
2005/0163519 A1 * 7/2005 Takahashi ..... 399/49

FOREIGN PATENT DOCUMENTS

JP A 10-10830 1/1998
JP A 11-212329 8/1999
JP A 2000-155453 6/2000
JP A 2001-134043 5/2001
JP A 2001-201904 7/2001
JP A 2002-62709 2/2002

* cited by examiner

*Primary Examiner*—Gail Verbitsky
(74) *Attorney, Agent, or Firm*—Oliff & Berridge, PLC

(57) ABSTRACT

During a first rotation of a photoconductor, latent electrostatic images for color correction processing patterns are formed on the photoconductor, and the latent electrostatic images are developed into the color correction processing patterns in each of four colors, and then densities of the patterns on the photoconductor are detected. During a second rotation of the photoconductor, each color of the patterns is recovered back into a developer device.

12 Claims, 7 Drawing Sheets

110
100
MICROCOMPUTER
OPC DENSITY DETECTION SENSOR
70
TIB DENSITY DETECTION SENSOR
71
82
41
80
MAIN MOTOR
DRIVE GEAR
SECOND BELT PHOTOCONDUCTOR ROLLER
53
FIRST INTERMEDIATE TRANSFER BELT ROLLER
SCANNER UNIT
21
DEVELOPER ROLLERS
37
YELLOW POSITIONING SOLENOID
38Y
MAGENTA POSITIONING SOLENOID
38M
CYAN POSITIONING SOLENOID
38C
BLACK POSITIONING SOLENOID
38K
OTHER CIRCUITS
50

IMAGE FORMING DEVICE THAT PERFORMS DENSITY DETECTION

BACKGROUND OF THE INVENTION

1. Field of the Invention

The present invention relates to an image forming device that employs an electrophotographic method using developers of a plurality of colors and, in particular, to an image forming device that detects color densities to perform color correction process.

2. Related Art

It is known in the art for a color laser printer to detect the densities of different colors and perform color correction based on the detection results (for example, Japanese Patent-Application Publication No. 2001-201904).

A typical color laser printer uses a method known as the four-cycle printing method, wherein a multicolor image is formed on an image-support member by four rotations of a photoconductor such that a monochromatic toner image is formed at each rotation of the photoconductor, and then the multicolor image on the image support member is transferred to a recording medium. When performing the density detection for each color in this printer, the photoconductor rotates four times in the same manner as during printing. Therefore, the density detection necessitates at least four rotations of the photoconductor, which takes too long a time.

In this four-cycle printing type of color laser printer, or in a tandem-style color laser printer in which one photoconductor is provided for each color, all of the toner used during density detection is discarded, which is a waste.

These problems are not limited to color laser printers, but occur in other image forming devices also.

SUMMARY OF THE INVENTION

It is an object of the present invention to overcome the above problems and also to provide an image forming device that enables efficient density detection.

In order to attain the above and other objects, according to one aspect of the present invention, there is provided an image forming device including a photoconductor that moves, an exposure unit that forms a latent electrostatic image on the photoconductor, a developing unit that develops the latent electrostatic image into a developer image, the developer unit being provided for each of a plurality of colors, an image support member that supports the developer image, a first transfer member that transfers the developer image from the photoconductor to the image support member, a second transfer member that transfers the developer image from the image support member onto a recording medium, a controller that controls the exposure unit and the developing unit, and a density detector that detects a density. While the exposure unit forms a first latent electrostatic image corresponding to a first developer image of each of the plurality of colors and the developing unit develops the first latent electrostatic image into the first developer image, the photoconductor moves by a first amount, the first developer image corresponding to a maximum printable size of the recording medium. The controller controls the exposure unit and the developing unit to form a second latent electrostatic image corresponding to a second developer image and to develop the second latent electrostatic image into the second developer image of each of the plurality of colors while the photoconductor moves by a second amount less than the first amount. The second developer image is for color correction process. The density detector detects the density of the second developer image.

For example, if the maximum printable size of the recording medium is A3 and the minimum printable size of the recording medium is B5, then the first amount is an amount necessary for forming a developer image corresponding to A3 size, and the second amount could be an amount that is necessary for forming a developer image corresponding to BS size.

According to another aspect of the present invention, there is provided an n image forming device including a plurality of photoconductors each corresponding to one of a plurality of colors, a plurality of exposure units each corresponding to one of the plurality of colors, each of the exposure units forming a latent electrostatic image on the corresponding one of the photoconductors, a plurality of developing units each corresponding to one of the plurality of colors, each of the developing units developing the latent electrostatic image formed on the corresponding one of the photoconductors into a developer image, an image support member that supports a developer image, a transfer unit that transfers the developer images each developed by one of the developing units onto the image support member, and a density detector that detects a density of a developer image. During printing, the transfer unit transfers the developer images in each of the plurality of colors such that the developer images are superimposed on the on the image support member thereby to produce a multicolor image. During density detection, the transfer unit transfers the developer images in each of the plurality of colors to mutually different positions of the image support member, and the density detector detects the density of each developer image supported on the image support member.

DETAILED DESCRIPTION OF PREFERRED EMBODIMENTS

Image forming devices according to embodiments of the present invention will be described with reference to the attached drawings. In a first embodiment, a four-cycle printing type of color laser printer is used as an example of the image forming device.

A color laser printer 1 according to the first embodiment of the present invention will be described with reference to FIGS. 1 to 5.

Figure 1:
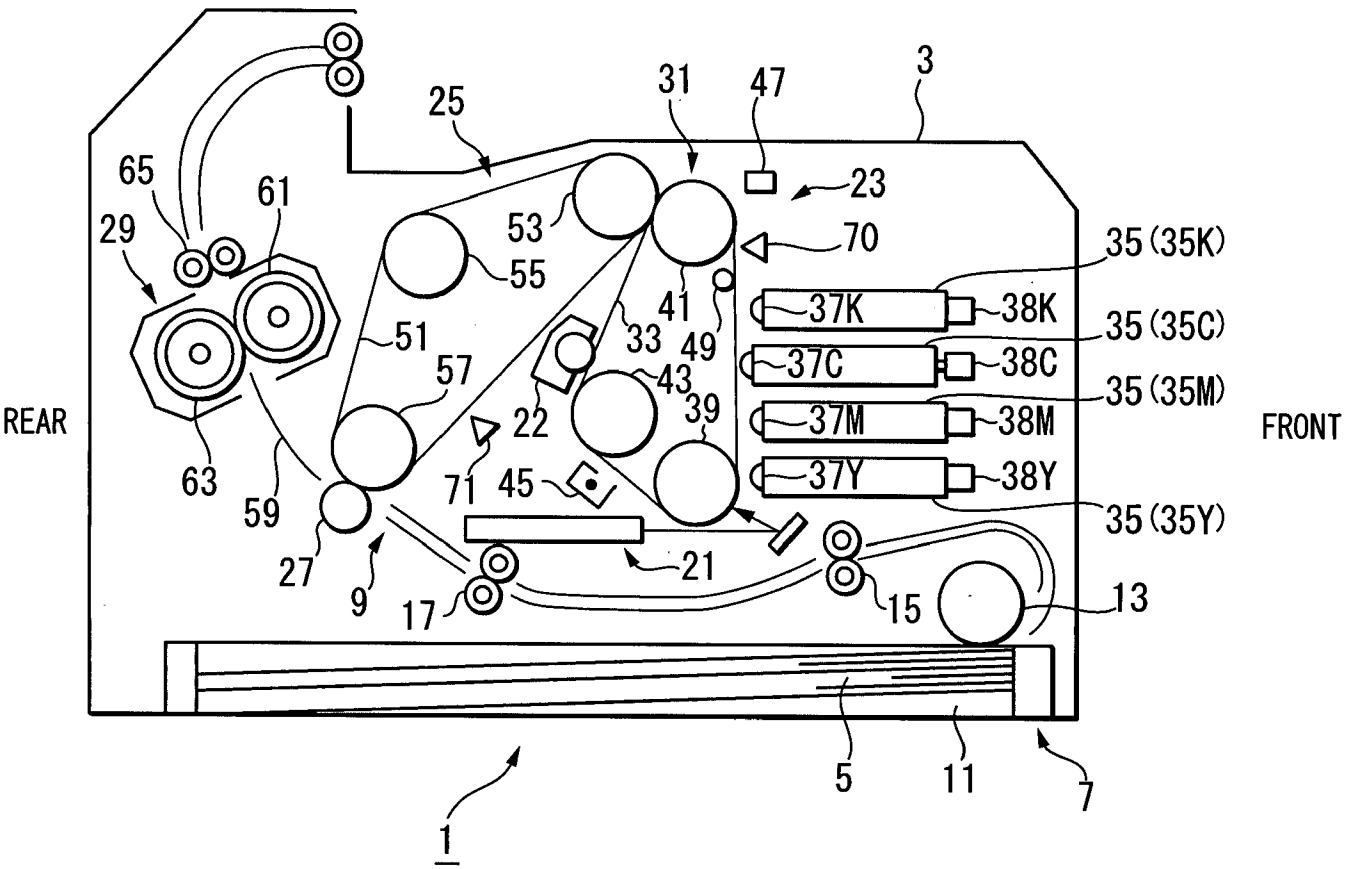
FIG. 1 is a schematic view of a color laser printer according to a first embodiment of the present invention.

As shown in FIG. 1, the color laser printer 1 includes a sheet supply portion 7, an image forming portion 9, and a main casing 3 that houses the sheet supply portion 7 and the image forming portion 9. The sheet supply portion 7 is for supplying a recording sheet 5, and the image forming portion 9 is for forming a predetermined image onto the recording sheet 5 supplied from the sheet supply portion 7.

The sheet supply portion 7 is provided with a sheet supply tray 11, a sheet supply roller 13, feed rollers 15, and register rollers 17. The sheet supply tray 11 accommodates a stack of recording sheets 5. The sheet supply roller 13 contacts the uppermost recording sheet 5 in the sheet supply tray 11 and extracts the recording sheets 5 one at a time by the rotation thereof. The feed rollers 15 and the register rollers 17 feed the recording sheet 5 to an image forming position.

The image forming position is a transfer position at which a toner image on an intermediate transfer belt (ITB) 51 (described later) is transferred onto the recording sheet 5. In this embodiment, the image forming position is a position at which the intermediate transfer belt 51 comes into contact with a transfer roller 27 (described later).

The image forming portion 9 includes a scanner unit 21, a process portion 23, an intermediate transfer belt mechanism 25, the transfer roller 27, and a fixer portion 29.

The scanner unit 21 includes a laser generation portion, a polygon mirror, a plurality of lenses, and reflective mirrors (not shown in the drawings) in a central portion within the main casing 3. In the scanner unit 21, a laser beam that is generated from the laser generation portion on the basis of image data is transmitted or reflected through the polygon mirror, the reflective mirrors, and the lenses, and scans at a high speed across a surface of a belt organic-photoconductor (OPC) 33 of a belt photoconductor mechanism 31 (described later).

The process portion 23 includes a plurality of developer cartridges 35 (four developer cartridges 35 in this embodiment) and the belt photoconductor mechanism 31. The four developer cartridges 35 are a yellow developer cartridge 35Y containing yellow toner, a magenta developer cartridge 35M containing magenta toner, a cyan developer cartridge 35C containing cyan toner, and a black developer cartridge 35K containing black toner, disposed sequentially in a vertical row from bottom to top at a predetermined mutual spacing toward the front within the main casing 3.

Each of the developer cartridges 35 includes a developer roller 37 (yellow developer roller 37Y, magenta developer roller 37M, cyan developer roller 37C, black developer roller 37K), a layer-thickness regulation blade, a supply roller, and a toner container portion (not shown). Each of the developer cartridges 35 can be moved in the horizontal direction by a corresponding one of positioning solenoids 38 (yellow positioning solenoid 38Y, magenta positioning solenoid 38M, cyan positioning solenoid 38C, black positioning solenoid 38K), so as to bring the developer roller 37 into contact with or away from the surface of the belt photoconductor 33.

Each developer roller 37 includes a metal roller shaft covered with a roller that is formed of an elastic member of a conductive rubber material. The roller of the developer roller 37 is formed to have a two-layer structure including a roller portion and a coating layer that covers the surface of the roller portion. The roller portion is an elastic body formed of a rubber, such as urethane rubber, silicone rubber, or EPDM rubber, containing carbon particles or the like. The coating layer has a main constituent that is urethane rubber, a urethane resin, or a polyimide resin. A developer bias, which is a sequence bias, is applied to the developer roller 37 with respect to the belt photoconductor 33 during development, and a predetermined recovery bias, which is a reverse bias, is applied during recovery of the toner. For example, the predetermined developer bias is +300V, and the predetermined recovery bias is −200V.

A toner container portion of each developer cartridge 35 is filled with spherical, positively charging, non-magnetic, single component, polymerized toner as the developer for the corresponding color yellow, magenta, cyan, or black. During development, the toner is supplied to the developer roller 37 by the rotation of the supply roller and given a positive electrical charge by friction between the supply roller and the developer roller 37. The toner on the developer roller 37 is introduced between the layer-thickness regulation blade and the developer roller 37 as the developer roller 37 rotates, where the toner acquires a further electrical charge by friction, so that a thin toner layer having a constant thickness is formed on the developer roller 37. During recovery, the recovery bias is applied to the developer roller 37 so that toner is recovered from the belt photoconductor 33 and stored back into the toner container portion.

The belt photoconductor mechanism 31 includes a first belt photoconductor roller 39, a second belt photoconductor roller 41, a third belt photoconductor roller 43, the photoconductor 33, a belt photoconductor electrostatic charger 45, a potential applicator 47, and a potential gradient controller 49. The configuration of the belt photoconductor mechanism 31 will be described later.

The intermediate transfer belt mechanism 25 is disposed to the rear of the belt photoconductor mechanism 31 and includes the intermediate transfer belt (ITB) 51, a first intermediate transfer belt roller 53, a second intermediate transfer belt roller 55, and a third intermediate transfer belt roller 57. The first intermediate transfer belt roller 53 is disposed substantially facing the second belt photoconductor roller 41 with the belt photoconductor 33 and the intermediate transfer belt 51 interposed therebetween. The second intermediate transfer belt roller 55 is disposed diagonally rearward from the first intermediate transfer belt roller 53. The third intermediate transfer belt roller 57 is disposed rearward of the second intermediate transfer belt roller 55 and facing the transfer roller 27 with the intermediate transfer belt 51 interposed therebetween. The intermediate transfer belt 51 is looped around the rollers 53, 55, and 57. The intermediate transfer belt 51 is an endless belt formed of a resin, such as an electrically conductive polycarbonate or polyimide, in which are dispersed conductive particles of a material, such as carbon.

That is, the rollers 53, 55, and 57 are disposed in a triangular arrangement with the intermediate transfer belt 51 wound therearound. The first intermediate transfer belt roller 53 is driven to rotate by the operation of a main motor 80 (see FIG. 2) via a drive gear 82, and the rollers 55 and 57 are driven to rotate as the first intermediate transfer belt roller 53 rotates, so that the intermediate transfer belt 51 moves circumferentially (in the clockwise direction) around the rollers 53, 55, and 57.

The color laser printer 1 further includes an ITB density detection sensor 71 for detecting the density of a toner image of each color that has been formed on the intermediate transfer belt 51. The ITB density detection sensor 71 includes a light source that emits light in the infrared region, a lens that irradiates the intermediate transfer belt 51 with the light, and a phototransistor that receives the light reflected from the intermediate transfer belt 51.

The transfer roller 27 is rotatably supported and disposed facing the third intermediate transfer belt roller 57 with the intermediate transfer belt 51 sandwiched therebetween. The transfer roller 27 is formed of a metal roller shaft that is covered with a roller formed of an electrically conductive rubber material. A transfer roller separation/connection mechanism (not shown) moves the transfer roller 27 between a standby position that is separated from the intermediate transfer belt 51 and a transfer-enabling position in the vicinity of the intermediate transfer belt 51. At the transfer-enabling position, the transfer roller 27 presses the recording sheet 5 against the intermediate transfer belt 51 as the recording sheet 5 passes along the feed path 59.

During printing, the transfer roller 27 is placed at the standby position while toner images in each color are transferred sequentially to the intermediate transfer belt 51 as will be described later, and is moved to the transfer-enabling position when a multicolor image is formed on the intermediate transfer belt 51, that is, when transfer of all the toner images from the belt photoconductor 33 onto the intermediate transfer belt 51 has completed. During color correction process, the transfer roller 27 is placed at the standby position.

The predetermined transfer bias with respect to the intermediate transfer belt 51 is applied to the transfer roller 27 by a transfer bias application circuit (not shown) when the transfer roller 27 is at the transfer-enabling position.

The fixer portion 29 is disposed to the rear of the intermediate transfer belt mechanism 25 and includes a heating roller 61, a pressure roller 63, and a pair of feed rollers 65. The pressure roller 63 presses against the heating roller 61, and the feed rollers 65 are provided on the downstream side of the heating roller 61 and the pressure roller 63 with respect to a sheet feed direction in which the recording sheet 5 is transported. The heating roller 61 has an outer layer of silicone rubber, an inner layer of metal, and a halogen lamp for heating.

The belt photoconductor mechanism 31 of the image forming portion 9 will be described in more detail. The first belt photoconductor roller 39 is disposed facing the rear of the four developer cartridges 35, at a position lower than the yellow developer cartridge 35Y that is the lowermost developer cartridge 35. The first belt photoconductor roller 39 is a driven roller. The second belt photoconductor roller 41 is disposed above the first belt photoconductor roller 39, at a position higher than the black developer cartridge 35K which is the uppermost developer cartridge 35. The second belt photoconductor roller 41 is driven to rotate by the main motor 80 via the drive gear 82. The third belt photoconductor roller 43 is positioned to the rear of and diagonally above the first belt photoconductor roller 39. The third belt photoconductor roller 43 is a driven roller. Thus, these rollers 39, 41, and 43 are disposed in a triangular arrangement.

The potential applicator 47 is disposed adjacent to the second belt photoconductor roller 41 and applies a predetermined potential to the second belt photoconductor roller 41, using the power source of the belt photoconductor electrostatic charger 45.

The first and third belt photoconductor rollers 39 and 43 are formed of electrically conductive members, such as aluminum. The first and third belt photoconductor rollers 39 and 43 are in contact with a foundation layer (described later) of the belt photoconductor 33 and also connected to a GND terminal (not shown). With this configuration, the first and third belt photoconductor rollers 39 and 43 maintain the potential of the belt photoconductor 33 at ground level at positions where the rollers 39 and 43 contact the foundation layer.

The belt photoconductor 33 is wound around the first to third belt photoconductor rollers 39, 41, and 43. As the second belt photoconductor roller 41 rotates, the first and third belt photoconductor rollers 39 and 43 are driven to rotate, so that the belt photoconductor 33 rotates therearound (in the counterclockwise direction).

The belt photoconductor 33 is an endless belt having the foundation layer (an electrically conductive foundation layer) with a thickness of 0.08 mm and a photosensitive layer of a thickness of 25 μm formed on one side of the foundation layer. The foundation layer is made of a nickel conductor fabricated by a nickel electroforming method, and the photosensitive layer is made of a photoconductor of a polycarbonate resin.

The color laser printer 1 further includes an OPC density detection sensor 70 for detecting the density of toner images in each color that are formed on the belt photoconductor 33. The OPC density detection sensor 70 is disposed higher than the black developer cartridge 35K and includes a light source that emits light in the infrared region, a lens that irradiates the belt photoconductor 33 with the light, and a phototransistor that receives the light reflected from the belt photoconductor 33.

The belt photoconductor electrostatic charger 45 is disposed below the belt photoconductor mechanism 31 and at upstream side of an irradiation position, at which the belt photoconductor 33 is exposed by the scanner unit 21, with respect to the rotation direction of the belt photoconductor 33, in the vicinity of the first belt photoconductor roller 39. The belt photoconductor electrostatic charger 45 is disposed in confrontation with the belt photoconductor 33 with a predetermined spacing such that the belt photoconductor electrostatic charger 45 does not contact the belt photoconductor 33.

The belt photoconductor electrostatic charger 45 is a scorotron charger that generates a corona discharge from a charge wire made of tungsten or the like, to charge the surface of the belt photoconductor 33 to a positive uniform charge.

The potential gradient controller 49 is positioned between the second belt photoconductor roller 41 and the first belt photoconductor roller 39 at a position higher than the black developer cartridge 35K and contacts the foundation layer of the belt photoconductor 33. The potential gradient controller 49 grounds the potential of the foundation layer at location where the potential gradient controller 49 contacts the foundation layer.

Next, printing operations of the color laser printer 1 will be described. The printing operations are performed by a microcomputer 110 shown in FIG. 2 controlling various components of the color laser printer 1.

The topmost one of the recording sheets 5 accommodated in the sheet supply tray 11 of the sheet supply portion 7 is pressed by the sheet supply roller 13, and the recording sheets 5 are extracted one at a time by the rotation of the sheet supply roller 13. The extracted recording sheet 5 is supplied to the image forming position by the feed rollers 15 and the register rollers 17. A predetermined registration is performed to the recording sheet 5 by the register rollers 17.

The belt photoconductor electrostatic charger 45 charges the surface of the belt photoconductor 33 to a uniform positive charge, and then the scanner unit 21 exposes the surface of the belt photoconductor 33 with the laser beam at a high-speed scanning based on image data. Because the charge at the exposed portion is erased (the charge on the surface moves to the foundation layer), a latent electrostatic image is formed on the surface of the belt photoconductor 33 as an arrangement of positively-charged portions and non-charged portions in accordance with the image data.

During this time, the first and third belt photoconductor rollers 39 and 43 supply power to the foundation layer of the belt photoconductor 33, thereby maintaining the potential at the contact positions at ground level.

The yellow positioning solenoid 38Y moves the yellow developer cartridge 35Y horizontally rearward to bring the yellow developer roller 37Y into contact with the belt photoconductor 33 on which the latent electrostatic image is formed.

The yellow toner contained within the yellow developer cartridge 35Y has a positive charge so that the yellow toner adheres only to those parts on the belt photoconductor 33 that are not charged. As a result, a yellow visible toner image is formed on the belt photoconductor 33.

During this time, the magenta developer cartridge 35M, the cyan developer cartridge 35C, and the black developer cartridge 35K are moved horizontally forward by the corresponding positioning solenoids 38M, 38C, and 38K, to keep the cartridges 35M, 35C, and 35K separated from the belt photoconductor 33.

When the yellow visible toner image on the belt photoconductor 33 reaches a position opposite the intermediate transfer belt 51 as the belt photoconductor 33 rotates, the yellow visible toner image is transferred onto the surface of the intermediate transfer belt 51.

During this time, the potential applicator 47 applies the sequence bias of +300V to the second belt photoconductor roller 41 by using the power source of the belt photoconductor electrostatic charger 45. When that happens, the potential of the photosensitive layer in the vicinity of the second belt photoconductor roller 41 also reaches +300V, through the conductive foundation layer of the belt photoconductor 33. This generates a repulsion force between the positively charged yellow toner and the photosensitive layer, facilitating transfer of the yellow toner to the intermediate transfer belt 51.

In the similar manner, a latent electrostatic image is formed on the belt photoconductor 33 for magenta, and a magenta visible toner image is formed on the belt photoconductor 33. Then, the magenta visible toner image is transferred onto the intermediate transfer belt 51.

That is, a latent electrostatic image is again formed on the belt photoconductor 33. The magenta positioning solenoid 38M moves the magenta developer cartridge 35M horizontally rearward to bring the magenta developer roller 37M into contact with the belt photoconductor 33 on which the latent electrostatic image is formed. At the same time, the yellow developer cartridge 35Y, the cyan developer cartridge 35C, and the black developer cartridge 35K are moved horizontally forward by the corresponding positioning solenoids 38Y, 38C, and 38K, to keep the cartridges 35Y, 35C, and 35K separated from the belt photoconductor 33. Accordingly, the magenta visible toner image is formed on the belt photoconductor 33 by the magenta toner alone supplied from the magenta developer cartridge 35M. Then, the magenta visible toner image is transferred onto the intermediate transfer belt 51 when the toner image reaches the position opposite to the intermediate transfer belt 51, so that the magenta image is superimposed on the previously transferred yellow visible toner image.

The above-described operations are repeated for the cyan toner contained within the cyan developer cartridge 35C and the black toner contained within the black developer cartridge 35K, so that a multicolor image is formed on the intermediate transfer belt 51.

The multicolor image formed on the intermediate transfer belt 51 is transferred all together onto the recording sheet 5 by the transfer roller 27 that is located at the transfer-enabling position, as the recording sheet 5 passes between the intermediate transfer belt 51 and the transfer roller 27.

The heating roller 61 thermally fixes the multicolor image onto the recording sheet 5, as the recording sheet 5 passes between the heating roller 61 and the pressure roller 63. The recording sheet 5 with the color image fixed thereon is then fed to a pair of sheet delivery rollers by feed rollers 65. Then, the recording sheet 5 is delivered by the sheet delivery rollers into a sheet delivery tray that is formed in an upper portion of the main casing 3.

That is, a latent electrostatic image is formed by exposure every time the belt photoconductor 33 makes one revolution, and the latent electrostatic image is developed into a toner image. Then, the toner image is transferred onto the intermediate transfer belt 51 which is rotated in synchronization with the rotation of the belt photoconductor 33. These operations are repeated four times for forming a multicolor image, which is formed of toner images of four colors superimposed one on the other, and then the full-color toner image is transferred onto the recording sheet 5, thereby forming the multicolor image on the recording sheet 5.

Next, a density detection operation will be described. The density detection operation is necessary for performing a color correction process (calibration). The color correction process is performed before the above-described printing operation for adjusting the density of each color to be used during printing operations by adjusting the pulse width of the laser beam, the voltages applied to each of the developer rollers 37 and the belt photoconductor electrostatic charger 45, and the like. Note that the density detection operation is performed by the various components under the control of the microcomputer 110.

Figure 2:
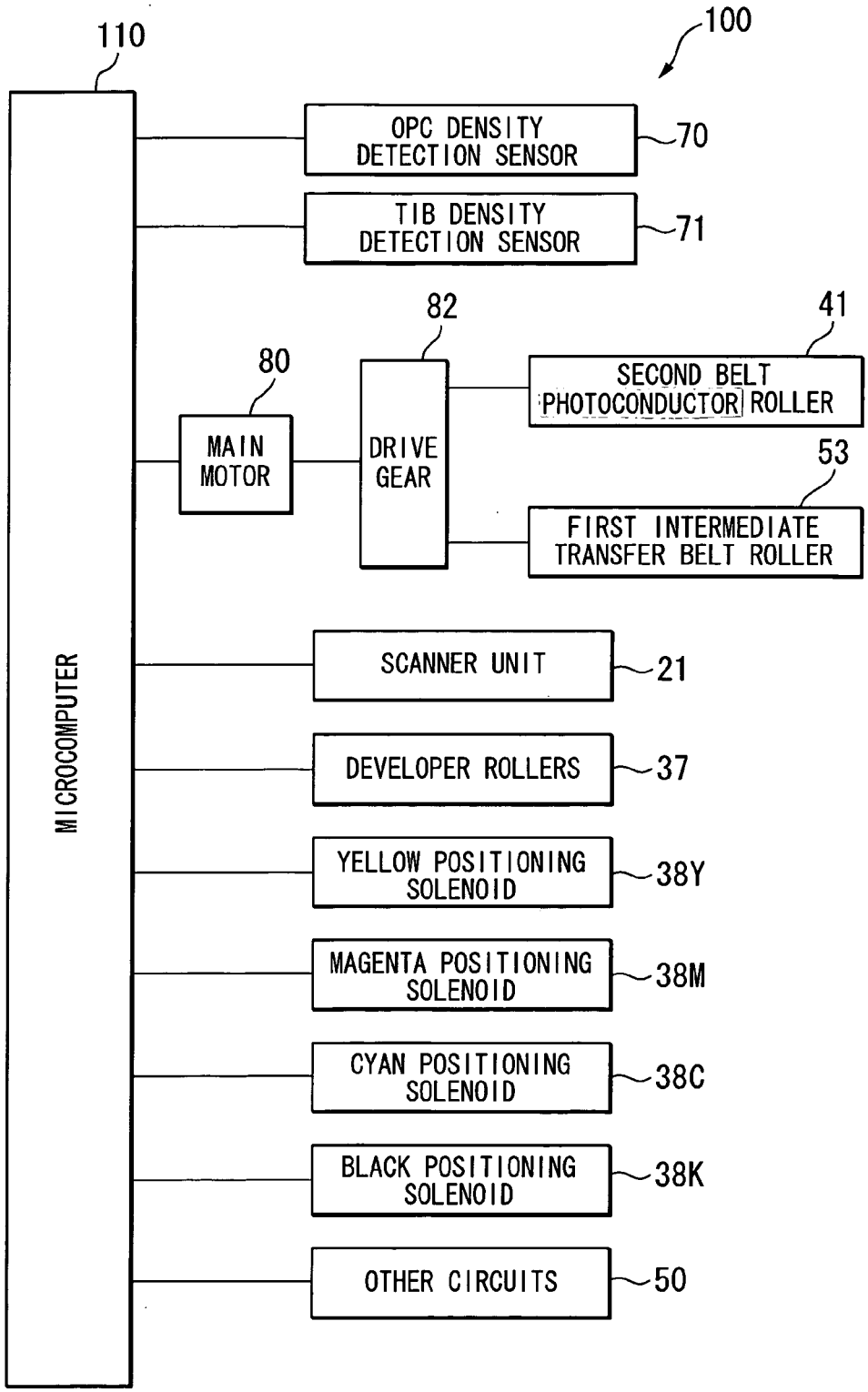
FIG. 2 is a block diagram of the color laser printer of FIG. 1.

FIG. 2 shows components that are necessary for the density detection operation, and all other components are summarized as other circuitry 50 in FIG. 2. Descriptions of these other components are omitted.

The description first concerns a density detection operation performed by using the OPC density detection sensor 70 (hereinafter referred to as "first density detection operation").

Figure 3:
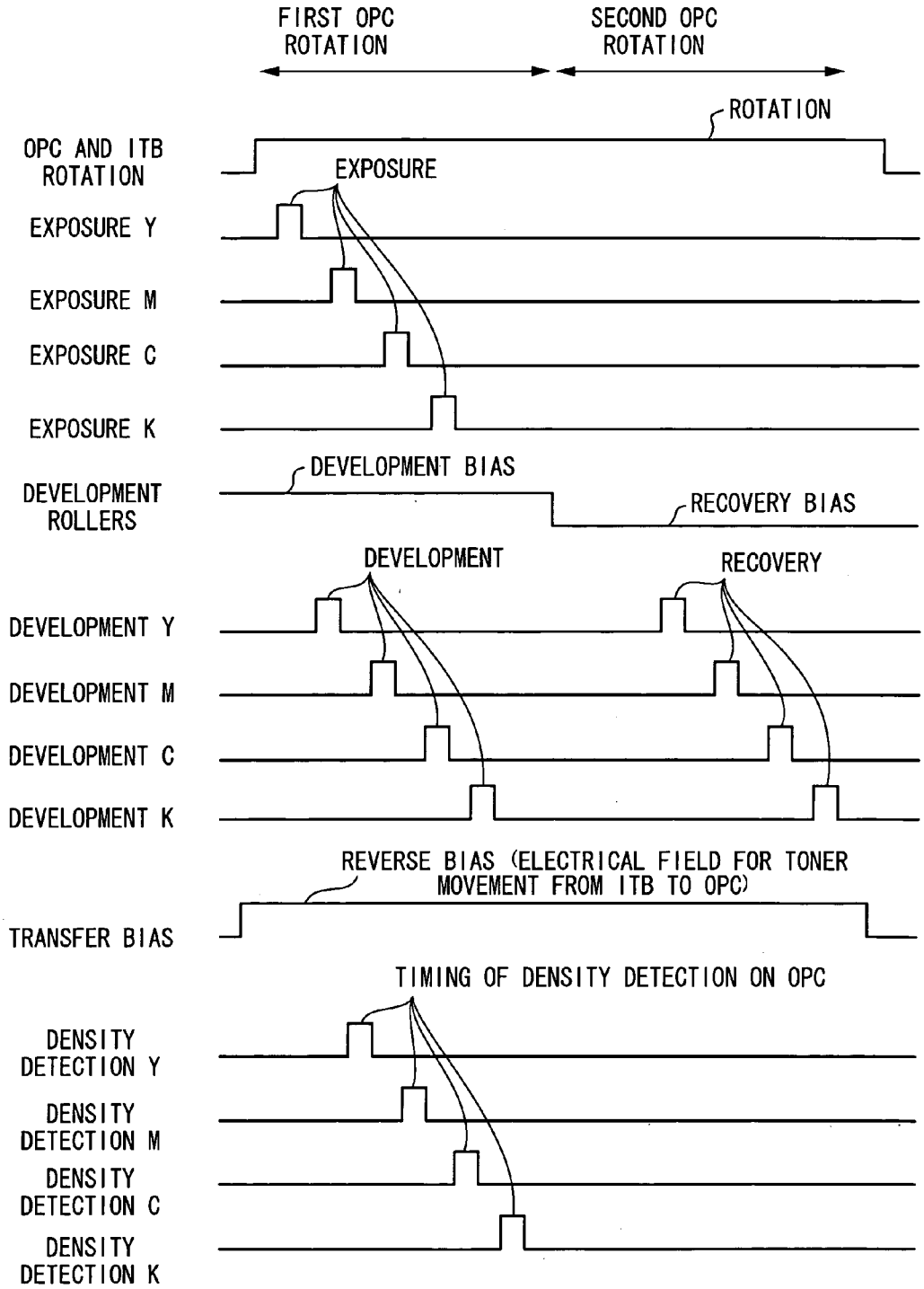
FIG. 3 is a timing chart illustrating a first density detection operation according to the first embodiment.

FIG. 3 is a timing chart illustrating the first density detection operation. In this operation, density detection is performed for all of the yellow, magenta, cyan, and black (YMCK) colors in a first rotation of the belt photoconductor 33, and all of the YMCK toners used in the density detection is recovered in a second rotation of the belt photoconductor 33.

First, the transfer roller 27 is moved to the standby position. The sheet supply roller 13 is controlled not to rotate. The belt photoconductor 33 is then driven to rotate a total of two times, by the rotational drive of the second belt photoconductor roller 41 that is driven by the main motor 80 through the drive gear 82. During this time, a recovery bias (reverse bias) of +300V is applied to the first intermediate transfer belt roller 53, thereby generating an electrical field that attracts toner from the intermediate transfer belt 51 towards the belt photoconductor 33.

Then, the belt photoconductor electrostatic charger 45 charges the surface of the belt photoconductor 33 to a uniform positive charge. The scanner unit 21 exposes the surface of the belt photoconductor 33 with the scanning of the laser light, thereby forming latent electrostatic images corresponding to color correction processing patterns 91 shown in FIG. 4 while the belt photoconductor 33 rotates one time. In other words, latent electrostatic images corresponding to a yellow color correction processing pattern 91Y, a magenta color correction processing pattern 91M, a cyan color correction processing pattern 91C, and a black color correction processing pattern 91K are sequentially formed on the belt photoconductor 33 while the belt photoconductor 33 rotates once. Each color correction processing pattern 91 has a region for solid color and a region for half-tone. The timings of these exposure operations correspond to the timings indicated by "Exposure" for the exposure Y, the exposure M, the exposure C, and the exposure K in the timing chart of FIG. 3.

Here, as described above, the latent electrostatic image corresponding to the color correction processing patterns 91 is formed on the surface of the belt photoconductor 33 because the charge at the exposed portion is erased (moves to the foundation layer). At this time, the first and the third belt photoconductor rollers 39 and 43 maintain the potential of the foundation layer of the belt photoconductor 33 at the ground level.

The yellow positioning solenoid 38Y moves the yellow developer cartridge 35Y horizontally to the rear so that the yellow developer roller 37Y contacts the belt photoconductor 33 while the latent electrostatic image for the yellow color correction processing pattern 91Y on the belt photoconductor 33 is positioned opposite the yellow developer cartridge 35Y. Because the yellow toner contained within the yellow developer cartridge 35Y has a positive charge, the yellow toner adheres only to those parts on the belt photoconductor 33 that are not charged. As a result, the yellow color correction processing pattern 91Y, which is a yellow visible toner image, is formed on the belt photoconductor 33.

In the same manner, the magenta positioning solenoid 38M moves the magenta developer cartridge 35M horizontally to the rear so that the magenta developer roller 37M contacts the belt photoconductor 33 while the latent electrostatic image for the magenta color correction processing pattern 91M on the belt photoconductor 33 is positioned opposite the magenta developer cartridge 35M. Because the magenta toner contained within the magenta developer cartridge 35M has a positive charge, the magenta toner adheres only to those parts on the belt photoconductor 33 that are not charged. As a result, the magenta color correction processing pattern 91M, which is a magenta visible toner image, is formed on the belt photoconductor 33.

In the similar manner, the cyan positioning solenoid 38C moves the cyan developer cartridge 35C horizontally to the rear so that the cyan developer roller 37C contacts the belt photoconductor 33 while the latent electrostatic image for the cyan color correction processing pattern 91C on the belt photoconductor 33 is positioned opposite the cyan developer cartridge 35C. Because the cyan toner contained within the cyan developer cartridge 35C has a positive charge, the cyan toner adheres only to those parts on the belt photoconductor 33 that are not charged. As a result, the cyan color correction processing pattern 91C, which is a cyan visible toner image, is formed on the belt photoconductor 33.

In the similar manner, the black positioning solenoid 38K moves the black developer cartridge 35K horizontally to the rear so that the black developer roller 37K contacts the belt photoconductor 33 while the latent electrostatic image for the black color correction processing pattern 91K on the belt photoconductor 33 is positioned opposite the black developer cartridge 35K. Because the black toner contained within the black developer cartridge 35K has a positive charge, the black toner adheres only to those parts on the belt photoconductor 33 that are not charged. As a result, the black color correction processing pattern 91K, which is a black visible toner image, is formed on the belt photoconductor 33.

The timings of these development operations correspond to the timings indicated by "Development" for the development Y, the development M, the development C, and the development K in the timing chart of FIG. 3.

In this manner, the different colors of toner adhere onto the belt photoconductor 33 during one rotation, thereby forming the color correction processing patterns 91.

Figure 4:
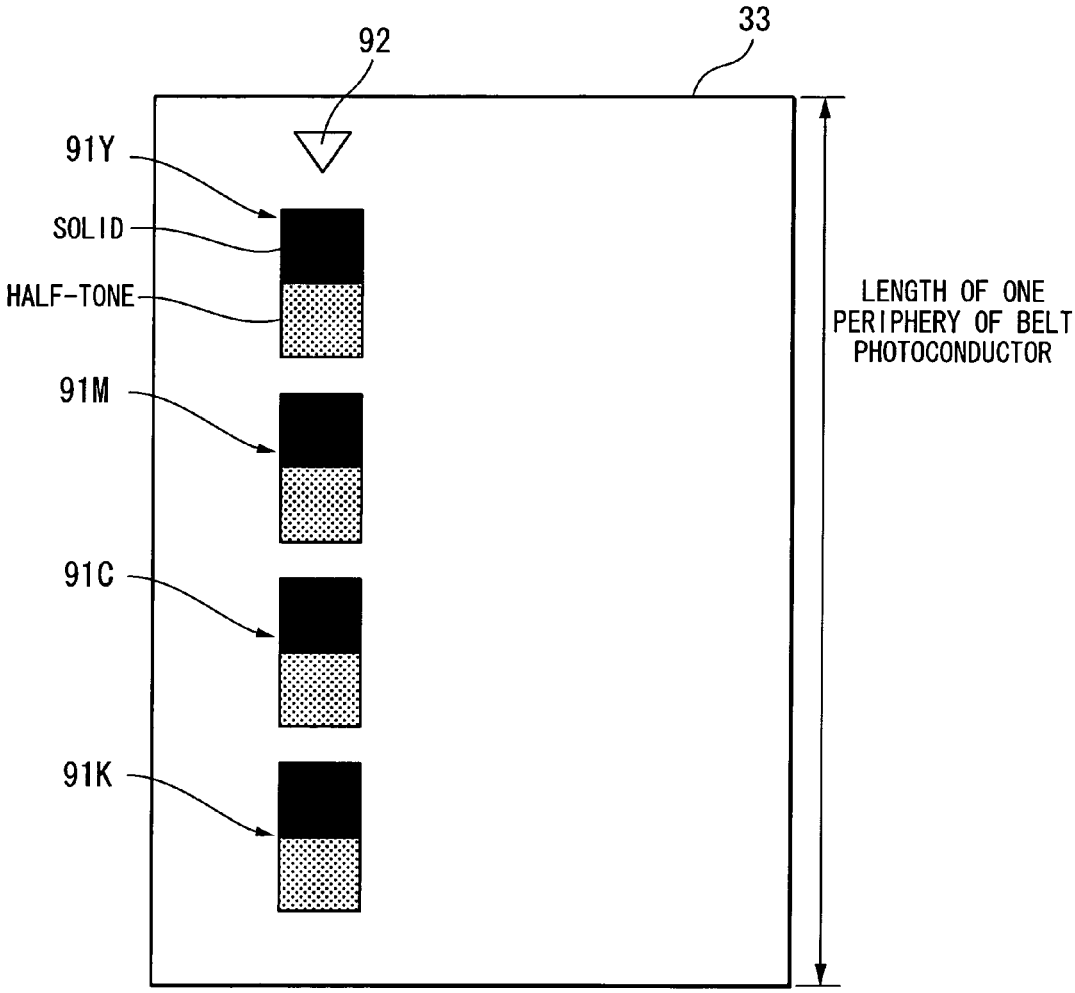
FIG. 4 is illustrative of color correction processing patterns.

Then, the OPC density detection sensor 70 detects the density of each of the YMCK toner images (color correction processing patterns 91Y, 91M, 91C, and 91K) at the OPC density detection timings shown in FIG. 3 at a density detection sensor position 92 shown in FIG. 4. Then, the OPC density detection sensor 70 outputs those densities to the microcomputer 110.

In this manner, the density detection for all the YMCK colors completes within one rotation of the belt photoconductor 33. In other words, conventional density detection is done while the belt photoconductor 33 rotates four times in a similar manner to that of printing as described previously. However, according to the present embodiment, the density detection completes within one rotation, so that density detection is performed rapidly.

Note that the color correction processing patterns 91 of this embodiment is formed within a range of the belt photoconductor 33 that is less than a range that is necessary for printing an image corresponding to the maximum sheet size that the color laser printer 1 can print upon. In addition, the total time during which the color developer rollers 37 are in contact with the belt photoconductor 33 during the formation of the color correction processing patterns 91 is shorter than the total time that the color developer rollers 37 have to be in contact with the belt photoconductor 33 during the printing of an image corresponding to the maximum sheet size that the color laser printer 1 can print upon.

Afterwards, as shown in FIG. 3, the recovery bias, which is a reverse bias, is applied to the developer rollers 37 during the second rotation of the belt photoconductor 33, so that toner is collected from the belt photoconductor 33 and stored into the toner storage portions.

More specifically, the yellow positioning solenoid 38Y moves the yellow developer cartridge 35Y horizontally to the rear so that the yellow developer roller 37Y contacts the belt photoconductor 33 while the yellow color correction processing pattern 91Y is positioned opposite to the yellow developer cartridge 35Y. As a result, yellow toner forming the yellow color correction processing pattern 91Y on the belt photoconductor 33 is attracted to the yellow developer roller 37Y and recovered into the yellow developer cartridge 35Y. During this time, the recovery bias of −200V is applied to the yellow developer roller 37Y.

In the same manner, the magenta positioning solenoid 38M moves the magenta developer cartridge 35M horizontally to the rear so that the magenta developer roller 37M contacts the belt photoconductor 33 while the magenta color correction processing pattern 91M is positioned opposite to the magenta developer cartridge 35M. As a result, magenta toner forming the magenta color correction processing pattern 91M on the belt photoconductor 33 is attracted to the magenta developer roller 37M and recovered into the magenta developer cartridge 35M. During this time, the recovery bias of −200V is applied to the magenta developer roller 37M.

In the similar manner, the cyan positioning solenoid 38C moves the cyan developer cartridge 35C horizontally to the rear so that the cyan developer roller 37C contacts the belt photoconductor 33 while the cyan color correction processing pattern 91C is positioned opposite to the cyan developer cartridge 35C. As a result, cyan toner forming the cyan color correction processing pattern 91C on the belt photoconductor 33 is attracted to the cyan developer roller 37C and recovered into the cyan developer cartridge 35C. During this time, the recovery bias of −200V is applied to the cyan developer roller 37C.

In the similar manner, the black positioning solenoid 36K moves the black developer cartridge 35K horizontally to the rear so that the black developer roller 37K contacts the belt photoconductor 33 while the black color correction processing pattern 91K is positioned opposite to the black developer cartridge 35K. As a result, black toner forming the black color correction processing pattern 91K on the belt photoconductor 33 is attracted to the black developer roller 37K and recovered into the black developer cartridge 35K. During this time, the recovery bias of −200V is applied to the black developer roller 37K.

The timings of these recovery operations correspond to the timings indicated by "Recovery" for the development Y, the development M, the development C, and the development K in the timing chart of FIG. 3. This makes it possible to recover the different colors of toner back into the respective developer cartridges 35 during the second rotation of the belt photoconductor 33.

In this manner, the toner used in the density detection is recovered without being wasted, enabling the implementation of more efficient density detection.

After the above-described density detection, the microprocessor performs the color correction process based on the detection results. Since the color correction process is well known in the art, description thereof is omitted.

Next, a density detection operation performed by using the ITB density detection sensor 71 (hereinafter referred to as "second density detection operation") will be described.

Figure 5:
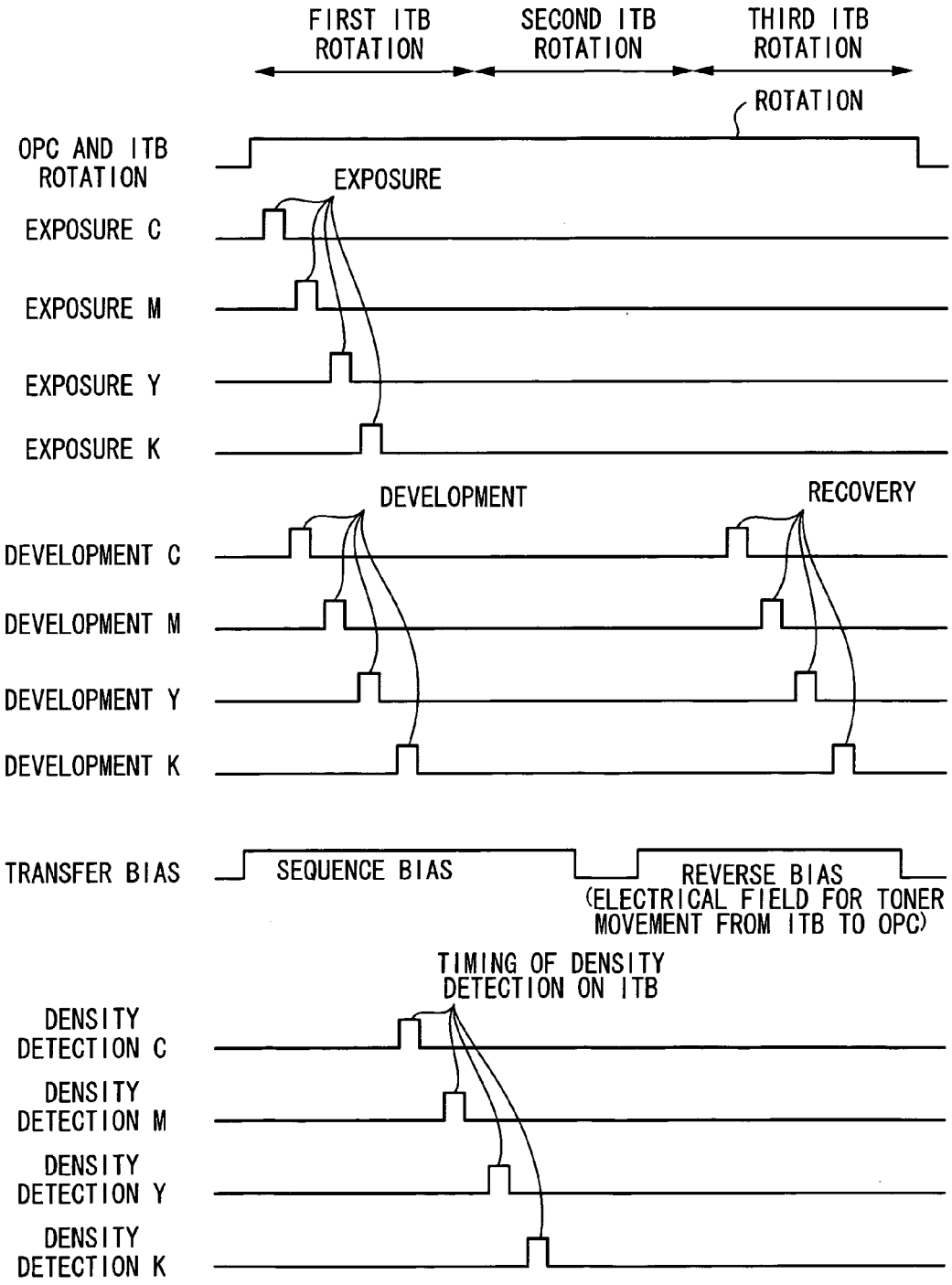
FIG. 5 is a timing chart illustrating a second density detection operation according to the first embodiment.

FIG. 5 shows a timing chart illustrating the second density detection operation. In this operation, the color correction processing patterns 91 is formed on the belt photoconductor 33 by performing the exposure and developing operations in the similar manner as in the above-described first density detection operation. In addition, in this operation, the sequence bias is applied to the second belt photoconductor roller 41 so as to transfer the color correction processing patterns 91 from the belt photoconductor 33 onto the intermediate transfer belt 51, and then the color correction processing patterns 91 transferred on the intermediate transfer belt 51 is detected by the ITB density detection sensor 71.

Accordingly, the density detection of all the YMCK colors completes during the first half of the second rotation of the intermediate transfer belt 51, as shown at "timing of density detection on ITB" in FIG. 5.

Also, after the transfer of the color correction processing patterns 91 from the belt photoconductor 33 onto the intermediate transfer belt 51 has completed, the transfer bias to the second belt photoconductor roller 41 is switched to the reverse bias, so that the color correction processing patterns 91 on the intermediate transfer belt 51 is transferred back to the belt photoconductor 33.

Then, the different colors of toner that is forming the color correction processing patterns 91 on the belt photoconductor 33 are recovered back into the corresponding developer cartridges 35, in the same manner as in the above-described first density detection operation.

In this manner, exposure, development, density detection, and toner recovery for each color are performed at the timings shown in FIG. 5. That is, the density detection is completed within two rotations of the intermediate transfer belt (ITB) 51, and toner recovery is completed within three rotations of the intermediate transfer belt 51.

Conventional density detection is done while the intermediate transfer belt 51 rotates four times in a similar manner to that of printing. However, according to the present embodiment, the density detection completes within two rotations of the intermediate transfer belt 51. Accordingly, density detection is performed rapidly. Also, the toner used in the density detection can be recovered without being wasted, enabling the implementation of more efficient density detection.

Moreover, because density of each color correction processing pattern 91 which has been transferred onto the intermediate transfer belt 51 is detected, calibration can be performed with taking the transfer efficiency between the belt photoconductor 33 and the intermediate transfer belt 51 into consideration. Because the density detection is performed at portions close to the position where toner images are transferred onto a recording sheet 5, the accuracy of the calibration can be increased.

It should be noted that in the above-described first embodiment, the four-color color laser printer 1 was used as an example of a color laser printer. However, the color laser printer could be any color laser printer that uses n colors (where n is an integer of at least 2), such as two colors or six colors.

Also, although in the above-described first embodiment the color laser printer 1 was used as an example of an image forming device, the image forming device could be other devices, such as a multifunction device having the function of such a color laser printer, a facsimile machine, or the like.

In the first embodiment, the toner used for the density detection operation was recovered into the developer cartridges 35. However, the toner used for the density detection operation could be collected by a cleaner 22 (see FIG. 1) that is disposed downstream of a position, where the belt photoconductor 33 and the intermediate transfer belt 51 contact each other, with respect to the rotational direction of the belt photoconductor 33 and upstream of a position, where the belt photoconductor 33 and the belt photoconductor electrostatic charger 45 confront each other with respect to the rotational direction of the belt photoconductor 33.

For example, the cleaner 22 could include a cleaning box, a cleaning roller, a removal roller, and a cleaning blade. The cleaning box has a box shape having a lower space therein, and is formed with an opening formed in a part of the side that faces the belt photoconductor 33. The cleaning roller is formed of a metal roller body covered with an elastic body of silicone rubber. The cleaning roller is rotatably supported in the opening of the cleaning box and is disposed facing the belt photoconductor 33. The cleaning roller is applied with a predetermined cleaning bias with respect to the belt photoconductor 33. The removal roller is formed of a metal roller and is disposed within the cleaning box on the opposite side of the cleaning roller from the belt photoconductor 33, in contact with the cleaning roller. The removal roller is applied with a predetermined removal bias with respect to the cleaning roller. The cleaning blade is disposed inside the cleaning box on the opposite side of the removal roller from the cleaning roller, so as to be pressed into contact with the removal roller. The cleaning blade is a scraping blade having a thin-plate shape.

After the density detection completes, the toner that is forming the color correction processing patterns 91 on the belt photoconductor 33 is electrically attracted to and captured by the cleaning roller when the toner is brought opposite to the cleaning roller by the rotation of the belt photoconductor 33. The toner captured by the cleaning roller is subsequently electrically captured by the removal roller when the rotation of the cleaning roller brings the toner opposite to the removal roller. Then, the toner is subsequently scraped off by the cleaning blade and collected in the lower space of the cleaning box.

With this configuration, the toner can be removed from the belt photoconductor 33 immediately after the density detection, although the toner cannot be reused. Accordingly, the density detection can be performed faster than the case in which the toner is reclaimed into the developer cartridges 35.

Next, a second embodiment of the present invention will be described. In this embodiment, a tandem-type color laser printer 201 shown in FIG. 6 is described as an example of the image forming device.

Figure 6:
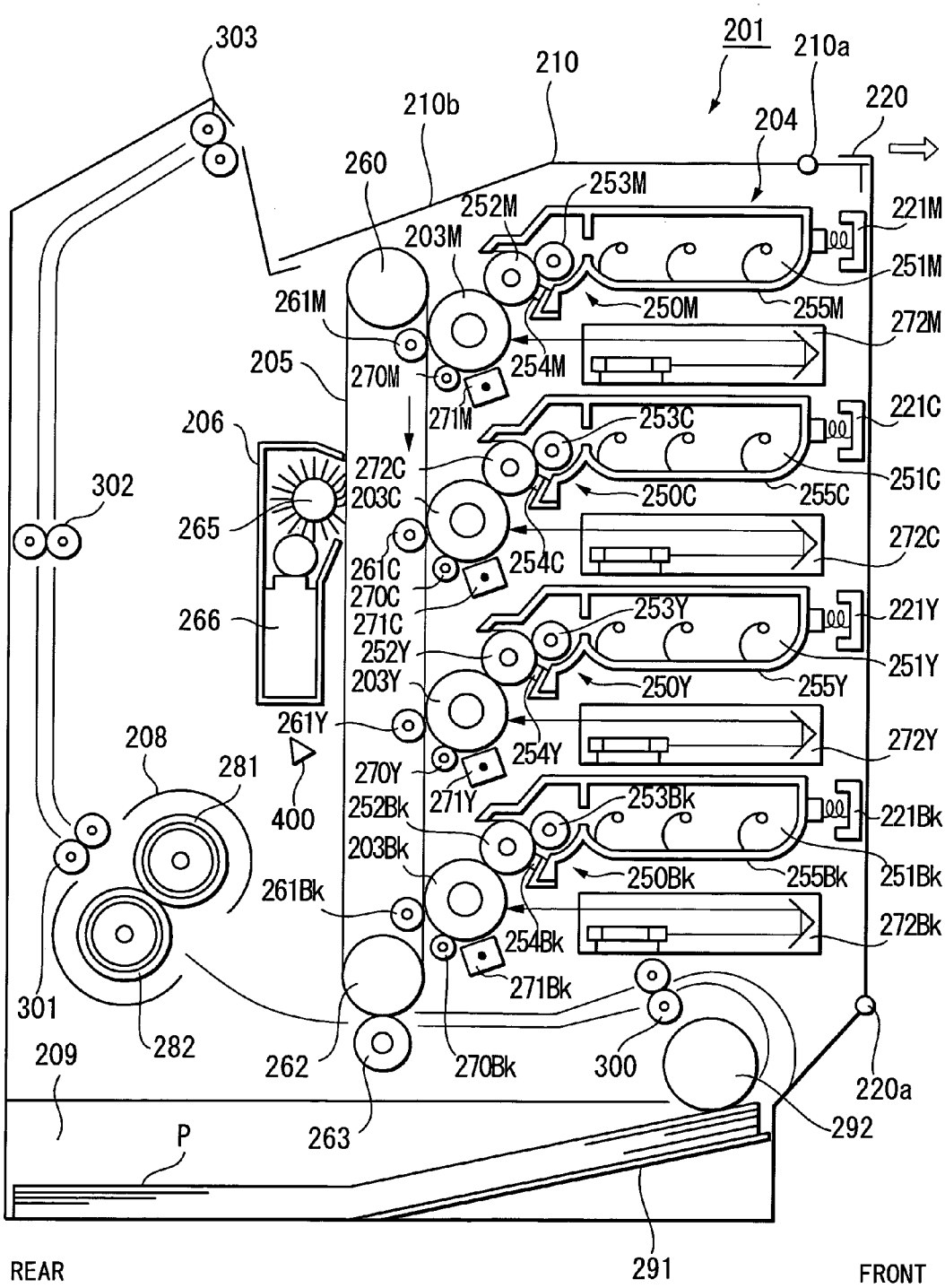
FIG. 6 is a schematic view of a color laser printer according to a second embodiment of the present invention) and FIG. 7 is a timing chart illustrating a density detection operation according to the second embodiment of the present invention.

As shown in FIG. 6, the color laser printer 201 includes a visible image forming portion 204, a belt-shaped intermediate transfer body (ITB) 205, a fixer portion 208, a supply portion 209, and a discharge tray 210*b*.

For each step in forming visible images with toner of the colors magenta (M), cyan (C), yellow (Y), and black (Bk), the visible image forming portion 204 includes developing units 251M, 251C, 251Y, and 251Bk (collectively referred to as "developing units 251"), drum photoconductors 203M, 2103C, 203Y, and 203Bk (collectively referred to as "drum photoconductors 203"), cleaning rollers 270M, 270C, 270Y, and 270Bk (collectively referred to as "cleaning rollers 270"), charging units 271M, 271C, 271Y, and 271Bk (collectively referred to as "charging units 271"), and exposure devices 272M, 272C, 272Y, and 272Bk (collectively referred to as "exposure devices 272").

The aforementioned components will be described in greater detail. The developing unit 251M will be described first. Note that since the developing units 251M, 251C, 251Y, and 251Bk are identical, only the developing unit 251M will be described, and description of the developing units 251C, 251Y, and 251Bk will be omitted to avoid duplication in explanation.

The developing unit 251M includes a developing roller 252M, a supply roller 253M, a thickness-regulating blade 254M, and a developing case 255. The developing roller 252M is formed in a cylindrical shape with a conductive silicon rubber as the base material, the surface of which is coated with a resin or a rubber material containing fluorine. However, the developing roller 252M need not be configured of a conductive silicon rubber as the base material, but instead may be configured of a conductive urethane rubber. The average roughness (Rz) at ten points on the surface of the developing roller 252M should be set to 3–5 μm in order to be smaller than the average particle size of toner, which is 9 μm.

The supply roller 253M is formed of a conductive sponge roller and is configured to contact the developing roller 252M with pressure applied by the elastic force of the sponge. The supply roller 253M can be configured of an appropriate foam member formed of a conductive silicon rubber, EPDM, or urethane rubber.

A base end of the thickness-regulating blade 254M is formed of stainless steel to a plate shape and fixed to the developing case 255M. A free end of the thickness-regulating blade 254M is formed of an insulating silicon rubber or an insulating rubber or synthetic resin containing fluorine. The free end of the thickness-regulating blade 254M contacts the developing roller 252M from the bottom side.

The developing case 255M accommodates toner which is a positively charging nonmagnetic single-component developer. The toner includes base toner particles having an average size of 9 μm. The base toner particles are formed by adding an additive, such as carbon black, well known in the art and a charge-controlling agent or charge-controlling resin, such as nigrosine, triphenylmethane, or quaternary ammonium salt, to a styrene-acrylic resin formed in a spherical shape through suspension polymerization. The toner is configured by adding silica to the surface of the base toner particles. The silica additive undergoes hydrophobing according to a process known in the art using a silane coupling agent, silicon oil, or the like. The average particle size of the silica is 1 nm, with the additive accounting for a 0.6% of the base toner particle weight. Toner of the colors magenta, cyan, yellow, and black are accommodated in the developing cases 255M, 255C, 255Y, and 255Bk, respectively.

The toner is a suspension polymerized toner very nearly spherical in shape. Also, the hydrophobed silica having an average particle size of 10 nm has been added to the particles at 0.6% weight. Therefore, the toner has excellent fluidity, and a sufficient charge amount can be obtained by triboelectric charging. Further, since the toner has no sharp edges like coarsely ground toner, the particles are less affected by mechanical forces and readily follow the electric field, thereby achieving efficient transfer.

The drum photoconductors 203 are formed, for example, of an aluminum base covered by a positively charged photosensitive layer. The photosensitive layer is formed at a thickness of 20 μm or greater. Further, the aluminum base is used as a grounding layer.

The cleaning rollers 270 are formed of conductive materials, such as a conductive sponge, and are disposed below the corresponding drum photoconductors 203 in sliding contact with the same. A power source not shown in the drawings applies a voltage of negative polarity, which is the opposite polarity from the toner, to the cleaning rollers 270. The cleaning rollers 270 remove residual toner on the drum photoconductors 203 by the frictional force on the drum photoconductors 203 and the effects of the electric field generated by the above voltages. Since the present embodiment employees a cleanerless developing method, residual toner removed from the cleaning rollers 270 is once again returned to the drum photoconductors 203 and further to the developing units 251 via the developing rollers 252 within a prescribed cycle after the developing process has been completed.

The charging units 271 are Scorotron-type charging devices and confront the surfaces of the drum photoconductors 203 from the bottoms thereof at positions downstream of the cleaning rollers 270 in the rotational direction of the drum photoconductors 203 so as to not contact the surface of the drum photoconductors 203.

The exposure devices 272 are each configured of a laser scanner unit well known in the art. The exposure devices 272 are disposed in vertical alignment with the developing units 251 and also in alignment with the drum photoconductors 203 and the charging units 271 in the horizontal direction.

The exposure devices 272 irradiate laser light based on image data onto the surfaces of the drum photoconductors 203 at positions downstream from the charging units 271 in the rotational direction of the drum photoconductors 203 so as to form latent electrostatic images for each color on the surfaces of the drum photoconductors 203.

The toner is positively charged, supplied from the supply roller 253M, 253C, 253Y, 253Bk to the developing roller

252M, 252C, 252Y, 252Bk, and formed to a uniform layer of thin thickness by the thickness-regulating blade 254M, 254C, 254Y, 254Bk. This construction effectively develops positively charged latent images formed on the drum photoconductors 203 with the positively charged toner according to a reverse developing method in which the positively-charged toner is attracted to negatively-charged areas of the drum photoconductors 203 at points of contact between the developing rollers 252 and the drum photoconductors 203, thereby forming an image of very high quality.

The intermediate transfer body 205 is a conductive sheet formed of polycarbonate, polyimide, or the like that is configured in a belt shape. The intermediate transfer body 205 is looped around two drive rollers 260 and 262. Intermediate transfer rollers 261M, 261C, 261Y, and 261Bk are disposed near positions opposing the drum photoconductors 203. The surface of the intermediate transfer body 205 on the side opposing the drum photoconductors 203 moves vertically downward as shown in FIG. 6.

A prescribed voltage is applied to the intermediate transfer rollers 261 in order to transfer toner deposited on the drum photoconductors 203 to the intermediate transfer body 205. A secondary transfer roller 263 is disposed at the position in which the toner image is transferred to a paper P, that is, opposite the drive roller 262 disposed at the lower end of the intermediate transfer body 205. A prescribed potential is applied to the secondary transfer roller 263, so that a four-color toner image carried on the intermediate transfer body 205 is transferred onto the paper P.

As shown in FIG. 6, a cleaning unit 206 is disposed on the opposite side of the intermediate transfer body 205 from the drum photoconductors 203. The cleaning unit 206 includes a scraping device 265 and a case 266. Toner remaining on the intermediate transfer body 205 is scraped off by the scraping device 265 and accumulates in the case 266. Note that during the color correcting process, the cleaning unit 206 is not used.

The fixer portion 208 includes first and second heating rollers 281 and 282. A paper P carrying a four-color toner image is heated and compressed by the first and second heating rollers 281 and 282 while being conveyed therebetween, thereby fixing the toner image to the paper P.

The supply portion 209 is disposed on the bottom of the printer 201 and includes a loading tray 291 for accommodating the stacked paper P and a pickup roller 292 for feeding the paper P. The supply portion 209 feeds the paper P at a prescribed timing in relation to the image forming process performed by the exposure devices 272, the developing units 251, the drum photoconductors 203, and the intermediate transfer body 205. A pair of conveying rollers 300 conveys the paper P fed by the supply portion 209 to the nip point between the intermediate transfer body 205 and the secondary transfer roller 263.

An upper cover 210 is rotatably supported at the uppermost portion of the device by a shaft 210*a*. A portion of the upper cover 210 serves as the discharge tray 210*b*. The discharge tray 210*b* is disposed at the discharge end of the fixer portion 208. The discharge tray 210*b* accommodates paper P discharged from the fixer portion 208 and conveyed by pairs of conveying rollers 301, 302, and 303.

A front cover 220 is configured to swing open about a shaft 220*a* in the direction indicated by an arrow in FIG. 6. By opening the front cover 220, the developing units 251 can be easily replaced. Springs 221M, 221C, 221Y, and 220Bk are provided to the front cover 220 at positions confronting the developing units 251. When the front cover 220 is closed, the springs 221M, 221C, 221Y, and 220Bk press the developing units 251 rearward (to the left in FIG. 6).

Next, printing operations of the printer 201 according to the present embodiment will be described. First, the charging units 271 apply a uniform charge to the photosensitive layers on the drum photoconductors 203. Next, these photosensitive layers are exposed to the exposure devices 272 based on image data for the colors magenta, cyan, yellow, and black, thereby forming latent electrostatic images. The developing units 251M, 251C, 251Y, and 251Bk deposit magenta toner, cyan toner, yellow toner, and black toner on the latent electrostatic images formed on the photosensitive layers of the corresponding drum photoconductors 203 to develop the magenta, cyan, yellow, and black colors of the image. The toner images in magenta, cyan, yellow, and black that formed in this way are transferred onto the surface of the intermediate transfer body 205. The toner image for each color is formed at slightly different times with consideration for the velocity of the intermediate transfer body 205 and the positions of the drum photoconductors 203 in order to superimpose the toner images of each color on the intermediate transfer body 205. In this manner, a multicolor toner image is formed on the intermediate transfer body 205.

Toner remaining on the drum photoconductors 203 following the transfer is temporarily retained by the cleaning rollers 270.

The multicolor toner image formed on the intermediate transfer body 205 is then transferred to the paper P fed from the supply portion 209 at the nip point between the secondary transfer roller 263 and the intermediate transfer body 205. After the toner image is fixed to the paper P in the fixer portion 209, the paper P is discharged onto the discharge tray 210*b*. Hence, a multicolor image is formed on the paper P.

The description now turns to density detection operation that is performed for the color correction process (calibration) for adjusting the density of each color to be used during printing, by adjusting the voltages applied to the developer rollers 252 before the above-described forming (printing) of the color image.

Figure 7:
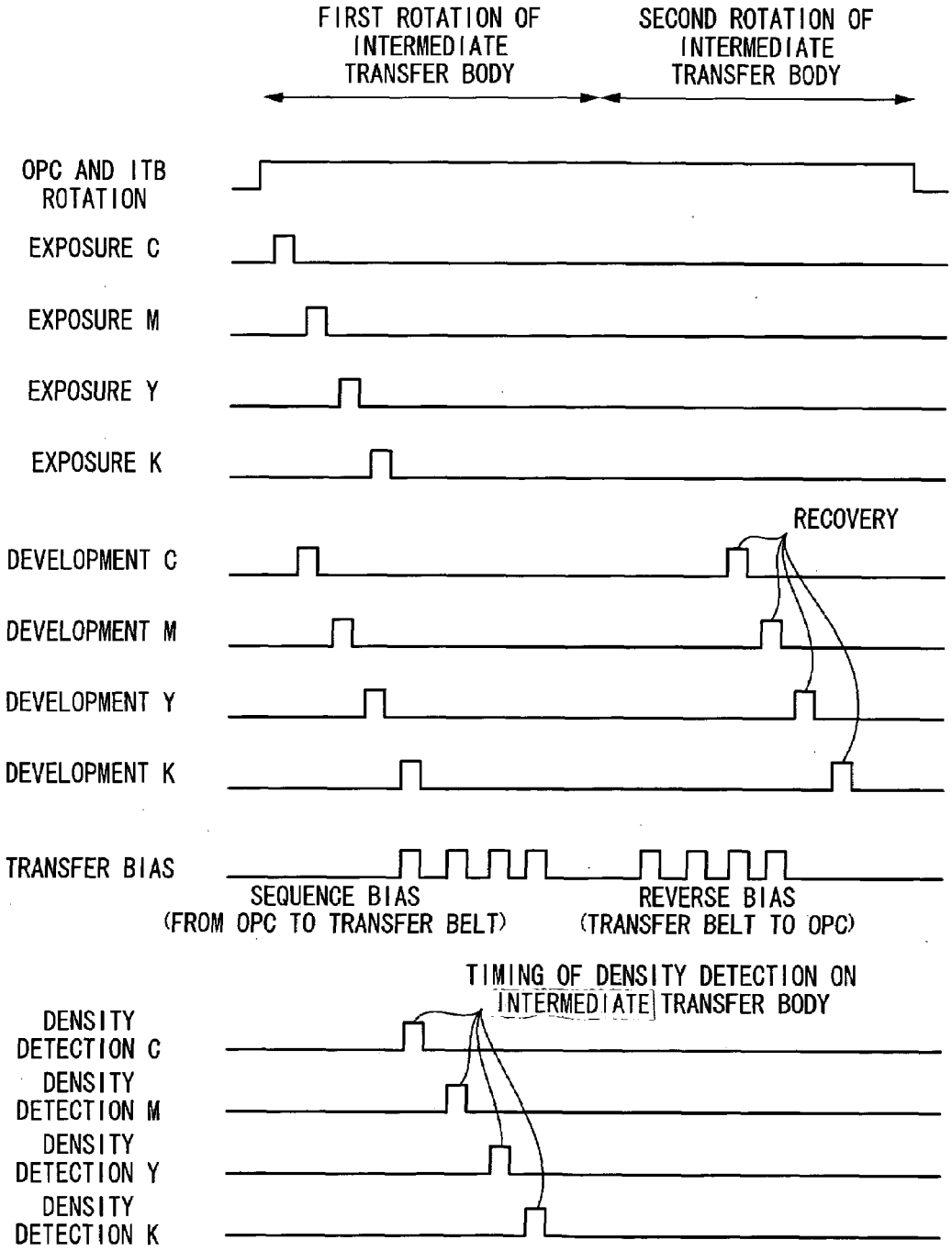

FIG. 7 shows a timing chart illustrating the density detection operation according to the present embodiment. IN the embodiment, the density detection operation is performed by using a density detection sensor 400. The density detection sensor 400 is disposed on the upstream side of the portion at which the intermediate transfer body 205 faces the cleaning device 206 at a position to the side of the intermediate transfer body 205 and opposite to the intermediate transfer body 205. The density detection sensor 400 detects the density of each of the CMYK colors on the intermediate transfer body 205 at a similar position to the density detection sensor position 92 shown in FIG. 4.

During the density detection operation, exposure and development are performed at the timings shown in FIG. 7 during the first rotation of the intermediate transfer body 205 in a similar manner to that of printing described previously so as to form the color correction processing patterns 91 shown in FIG. 4 within a region for one rotation of the intermediate transfer body 205. Note that unlike during the printing operations, the color correction processing patterns 91Y, 91M, 91C, 91K are transferred to mutually different positions of the intermediate transfer body 205 without being superimposed one on the other. Then, the density detection sensor 400 detects the density of each of the YMCK toner images (color correction processing patterns 91Y, 91M, 91C, and 91K) at the "timing of density detection on intermediate transfer body" shown in FIG. 7. In this manner, the density detection for all the YMCK colors completes within one rotation of the intermediate transfer body 205.

During the second rotation of the intermediate transfer body 205, a reverse bias is applied to the transfer rollers 261 while the corresponding color correction processing patterns 91 (91M, 91C, 91Y, 91Bk) on the intermediate transfer body 205 are at positions opposite to the corresponding drum photoconductors 203, so that the toner of the color correction processing patterns 91 on the intermediate transfer body 205 is transferred back onto the corresponding drum photoconductors 203. The reverse bias could be +1000V for example. During this time, +400V is applied to the cleaning rollers 270, so that toner of each color on the drum photoconductor 203 is recovered by corresponding one of the cleaning rollers 270. The timings of these recovery operations correspond to the timings indicated by "Recovery" for the development Y, the development M, the development C, and the development K in the timing chart of FIG. 7.

Afterwards, at appropriate timings, the toner recovered by the cleaning rollers 270 is recovered into the respective developing cases 255 via the drum photoconductors 203.

Accordingly, the toner used in the density detection operation can be recovered without being wasted, enabling the implementation of more efficient density detection operation.

As described above, according to the above-described embodiments, a density detection operation can be performed efficiently, thus shortening the time required for density detection operation. Therefore, in an image forming device in which printing starts only after the color correction process, the time taken until the printing operation starts can be shortened.

While some exemplary embodiments of this invention have been described in detail, those skilled in the art will recognize that there are many possible modifications and variations which may be made in these exemplary embodiments while yet retaining many of the novel features and advantages of the invention.

What is claimed is:

1. An image forming device comprising:

a photoconductor that moves;

an exposure unit that forms a latent electrostatic image on the photoconductor;

a developing unit that develops the latent electrostatic image into a developer image, the developer unit being provided for each of a plurality of colors;

an image support member that supports the developer image;

a first transfer member that transfers the developer image from the photoconductor to the image support member;

a second transfer member that transfers the developer image from the image support member onto a recording medium;

a controller that controls the exposure unit and the developing unit; and a density detector that detects a density, wherein while the exposure unit forms a first latent electrostatic image corresponding to a first developer image of each of the plurality of colors and the developing unit develops the first latent electrostatic image into the first developer image, the photoconductor moves by a first amount, the first developer image corresponding to a maximum printable size of the recording medium;

the controller controls the exposure unit and the developing unit to form a second latent electrostatic image corresponding to a second developer image and to develop the second latent electrostatic image into the second developer image of each of the plurality of colors while the photoconductor moves by a second amount less than the first amount, the second developer image being for color correction process; and the density detector detects the density of the second developer image.

2. The image forming device according to claim 1, wherein the photoconductor moves by rotation, and the density detector detects the densities of the second developer image for all of the plurality of colors during one rotation of the photoconductor.

3. The image forming device according to claim 1, wherein the image support member rotates, and the density detector detects the densities of the second developer image for all of the plurality of colors during one rotation of the image support member.

4. The image forming device according to claim 1 wherein:

the developing unit includes a plurality of developing rollers each corresponding to one of the plurality of colors, each of the plurality of developing rollers moving between a first position distanced from the photoconductor and a second position close to the photoconductor, the developing unit developing a latent electrostatic image by using the developing rollers located at the second positions; and the controller controls each of the plurality of developing rollers to move between the first position and the second position such that a total time during which any of the plurality of developing rollers is at the second position while the developing unit develops the second latent electrostatic image into the second developer image is shorter than a total time during which any of the plurality of developing rollers is at the second position while the developing unit develops the first latent electrostatic image into the first developer image.

5. The image forming device according to claim 4, wherein the exposure unit forms the second latent electrostatic image within a range of the photoconductor that is less than a range of the photoconductor within which the exposure unit forms the first latent electrostatic image.

6. The image forming device according to claim 1 wherein the density detector detects the density of the second developer image formed on the photoconductor.

7. The image forming device according to claim 6, wherein the first transfer member does not transfer the second developer image.

8. The image forming device according to claim 1, wherein the density detector detects the density of the second developer image on the image support member.

9. The image forming device according to claim 8, further comprising a reverse transfer member that transfers developer from the image support member onto the photoconductor.

10. The image forming device according to claim 9, wherein the developing unit recovers each color of developer clinging on the photoconductor.

11. The image forming device according to claim 1, wherein further comprising a recovery member that recover developer of the second developer image to dispose the developer.

12. The image forming device according to claim 1, wherein the controller executes a color correction process based on detection results of the density detector.

* * * * *